US005189856A

United States Patent [19]

Windstrup

[11] Patent Number: 5,189,856

[45] Date of Patent: Mar. 2, 1993

[54] DURABLE BUILDING MATERIALS HAVING EXPANDED POLYSTYRENE BASE

[76] Inventor: Edmund P. Windstrup, 275 Maple Ave., Palm Harbor, Fla. 34684

[21] Appl. No.: 837,440

[22] Filed: Jan. 4, 1991

[51] Int. Cl.[5] ..... B04C 1/00

[52] U.S. Cl. ..... 52/309.9; 52/309.9; 52/309.12

[58] Field of Search ..... 52/309.4, 309.9, 309.12, 52/612, 444; 156/79, 73, 307.5; 264/45.1, 45.3, 48; 428/319.1

[56] References Cited

U.S. PATENT DOCUMENTS

| | | | |
|---|---|---|---|
| 2,896,271 | 7/1958 | Kloote et al. | 52/309.9 |
| 3,660,187 | 5/1972 | Shortway et al. | 156/79 |
| 3,700,516 | 10/1972 | Sullivan | 52/309.4 |
| 4,303,722 | 12/1981 | Pilgrim | 428/319.1 |
| 4,489,126 | 12/1984 | Holtrup et al. | 156/78 |
| 4,601,150 | 7/1986 | Dougherty | 52/309.12 |
| 4,625,472 | 12/1986 | Busick | 52/612 |
| 4,640,862 | 2/1987 | Lakes | 52/309.4 |
| 4,774,794 | 10/1988 | Grieb | 52/309.4 |
| 4,788,803 | 12/1988 | Seitz | 52/309.12 |
| 4,798,032 | 1/1989 | Rose | 52/81 |
| 4,832,775 | 5/1989 | Park et al. | 156/307.5 |
| 4,906,423 | 3/1990 | Frisch | 264/48 |

*Primary Examiner*—James L. Ridgill, Jr.

*Attorney, Agent, or Firm*—Joseph C. Mason, Jr.; Ronald E. Smith

[57] ABSTRACT

A block of high density expanded polystyrene is cut into a preselected ornamental shape and one or two layers of a cementitious material are sprayed onto the block to produce a durable article of manufacture having utility as a structural element in the construction industry. Each layer of the cementitious material is about .015 inch thick so that detailed ornamental features are not filled in. The cutting and spraying are accomplished in a factory remote from the job site so that the construction crew at the job site need only attach the finished product to the building when it is delivered to the job site.

3 Claims, 1 Drawing Sheet

DURABLE BUILDING MATERIALS HAVING EXPANDED POLYSTYRENE BASE

TECHNICAL FIELD

This invention relates, generally, to building materials that include expanded polystyrene. More particularly, it relates to an expanded polystyrene-based building material that does not require mesh material and layers of cementitious material to strengthen it.

BACKGROUND ART

Architectural designs including unique or complex ornamentation have long been favored by architects and builders. For example, medieval cathedrals having complex ornamentation were hand crafted, using concrete or other suitable material that was laboriously formed into the desired shape.

In more modern times, building materials such as dry wall, plywood, and particle board have supplemented concrete and other cementitious materials. However, these newer materials are also quite difficult to form into unique or complex shapes. Moreover, these materials are of flat construction so that they cannot be used where three dimensional ornamentation calls for substantial depth.

When expanded polystyrene (EPS) was first invented, it was thought to have no utility in the construction industry because early EPS was quite soft and breakable; accordingly, it was used as a shock-absorbing packaging material and as a container within more durable containers.

However, builders noticed that it could easily be cut or molded into different shapes, so experiments began to determine whether or not it could be used to provide the ornamentation so difficult to achieve with cementitious materials, plywood and the like. The experimentation was extensive, because builders realized that if EPS proved suitable for use in ornamentation work, experienced and expensive carpenters and brickmasons would no longer be needed to create the free-form shapes so often prescribed by architects.

The results were unsatisfactory EPS, as expected, was too pliable to serve as a building material. It was light in weight and easy to install, but even the most routine contact damaged it. For example, a homeowner leaning a ladder against a house to gain access to the roof could destroy an EPS window ornamentation just by inadvertently bumping it with the ladder. In addition, EPS was found to be highly susceptible to damage caused by the ultraviolet rays of the sun.

EPS was so much easier to make into free forms and was so easy to work with and lowered the builder's costs so much, however, that it was not abandoned after the early disappointing trials. Instead, researchers began to look for ways to strengthen it so that it could withstand the bumps and abuses that any building material must withstand and to look for coatings that would protect it from ultraviolet damage.

The conventional wisdom was that, despite its lack of durability, EPS could somehow be strengthened and protected and its advantages and cost savings could therefore be realized.

However, before the invention of the process disclosed hereinafter, EPS has persisted in disappointing architects, builders and owners alike. Strengthening processes have been developed, but these processes have several drawbacks. For example, strengthening EPS has had the undesirable side effect of destroying the detailed ornamentation cut into the EPS.

The destruction of detail occurred because inventors increased the durability of EPS by coating it with a protective layer of concrete or stucco. It was found, however, that a standard concrete or stucco mix would not bond satisfactorily to EPS, but would tend to crack off even under light impact. Inventors then developed bonding agents made from latex or acrylic plastic resins, but even this relatively thin layer of cementitious material erased the shallow valleys of the underlying ornamental design cut into the EPS.

A further refinement was the mixing of these bonding and strengthening agents with a cement mixture to produce cementitious coatings that were stronger and bonded well with EPS. This significant new building process utilizing EPS was then developed. These coatings could be relatively thin and easy to apply by trowelling or spraying and when used with reinforcing mesh were proven to be adequately durable and provided sufficient protection to the EPS. This building system then became generally acceptable in the construction industry.

The current state of the art method for applying this cementitious system is to bond sheets of open mesh to the EPS. This can be accomplished by first trowelling the mesh in place with a primary or first coat of cementitious coating, or the mesh can be treated at the factory with a contract cement or even applied with a compatible adhesive at the job site. A primary coat of cementitious material, however, is needed to properly bond the EPS and the mesh which has to be fully embedded to protect it from ultraviolet damage to fully hide it prior to finishing. A second or finish coat is then applied, said coat can be cementitious with color added, or simply a compatible paint.

Although the resulting product is strong and thinner than a concrete system, this method still destroys the subtle details of ornamental design unless a considerable amount of hand labor is used to redefine the original design cut into the EPS. This can only be accomplished by carefully placing the mesh in direct relationship to the design and embedding the cementitious material so that it fully covers the mesh. This process is very labor intensive and expensive.

The art accordingly has reached an apparent impasse. Coatings that impart adequate durability to the EPS reduce its utility as an ornamental building structural element, and coatings that preserve at least some of its utility as an ornamental material are labor intensive and not cost effective It is apparent that the solution to this quandary is not obvious, in view of the prior art, to lay persons or to those of ordinary skill in the EPS and construction industries.

There is still another problem that plagues the industry as well. Once the EPS has been cut into shape at the factory, it must then be transported to the job site and attached to the house, apartment, office building or other structure under construction. Currently, adhesives and special large face mechanical fasteners are used to attach and hold the EPS in place. This attachment process is labor intensive. Moreover, the fasteners are expensive and the large face of the fastener pulls down into the soft foam. This then requires that the void created in the surface of the EPS be filled with a patching process.

Furthermore, as mentioned above, the layers of cementitious material to be trowelled or sprayed onto the EPS at the job site must be mixed at the construction site. Typically, the cementitious product is prepared by mixing a gallon of resin with a ninety four pound bag of concrete and one hundred fifty pounds of sand and adding water to obtain the desired consistency. This on site preparation of materials and subsequent application onto the EPS is a slow and costly process.

Nevertheless, it is still easier to cut a block of EPS into a desired ornamental shape at a factory, to transport that block of EPS to the job site, and to complete the above-described process than it is to construct ornamental elements by any other heretofore known method. Accordingly, even though the state of the art is not entirely satisfactory, the above-described cementitious covered EPS material is in widespread use by the construction industry.

Innovation in this field is clearly needed, but the teachings and suggestions of the art provide no clues as to what should be done.

DISCLOSURE OF INVENTION

The long awaited and revolutionary breakthrough in EPS construction technology is now revealed. The open mesh material and trowelled layer of concrete or cementitious material heretofore used in an attempt to strengthen EPS blocks are jettisoned in their entirety and the other teachings of the prior art are rejected as well.

The new teaching of how to strengthen EPS produces an EPS product that is so durable that the EPS can be attached to a building simply by driving a nail through it. Prior to this disclosure, no EPS block could be attached to a building by such a simple and time effective technique.

The durability-increasing cementitious layer that is applied to the EPS in the novel process disclosed hereinafter is so thin that the smallest, most subtle architectural features are preserved in all their delicacy. Thus, there is no need to redefine the features of the finished product.

This breakthrough is accomplished by selecting a different density of EPS than heretofore used by the construction industry, and by spraying said high density EPS with at least one layer of a cementitious product.

Since its advent on the scene as a building material, EPS having a density of about one pound per cubic foot has been used. The present inventor is the first, anywhere in the world, to recognize that EPS having a density of 1.5–3.0 pounds per cubic foot must be used as the starting material. This type of EPS is more durable than the low density EPS heretofore used.

The high density EPS is easy to form into ornamental shapes, i.e., it is almost as easy to form as the low density foams and its use is considerably more cost effective than adding layers of a cementitious material and mesh.

After forming, a coating of a cementitious product, sold under the trademark Sun Rock is sprayed, not troweled, onto the EPS base. The spraying is performed at the factory where the EPS is out into shape, not at the job site. The thickness of the first coating of Sun Rock is about 0.015 inch. Accordingly, the subtlest architectural detail is unaffected by the application of the Sun Rock.

Metal or mesh tabs may be formed into the EPS at the time of its manufacture to facilitate its attachment to buildings. This attachment technique was heretofore unknown. More importantly, as already mentioned, the high density EPS of the present invention allows it to be nailed into place, thereby greatly slashing installment costs.

It is therefore understood that the primary object of this invention is to revolutionize the industry that uses EPS as a building material.

A more specific object is to provide a method whereby EPS may be cut into detailed ornamental designs and strengthened without erasing those designs.

Still another object of this invention is to provide a building material that can be delivered to a job site in a finished condition so that the only job required by the construction crew is the installation of the structural element into position.

These and other important objects, advantages, and features of the invention will become apparent as this description proceeds. The invention accordingly comprises the features of construction, combination of elements and arrangement of parts that will be exemplified in the construction set forth hereinafter and the scope of the invention will be set forth in the claims.

BRIEF DESCRIPTION OF THE DRAWINGS

For a fuller understanding of the nature and objects of the invention, reference should be made to the following detailed description, taken in connection with the accompanying drawings, in which:

The FIG. 1 is a perspective view showing how the cementitious material of this invention is sprayed onto the high density EPS of this invention.

BEST MODES FOR CARRYING OUT THE INVENTION

Figure 1:
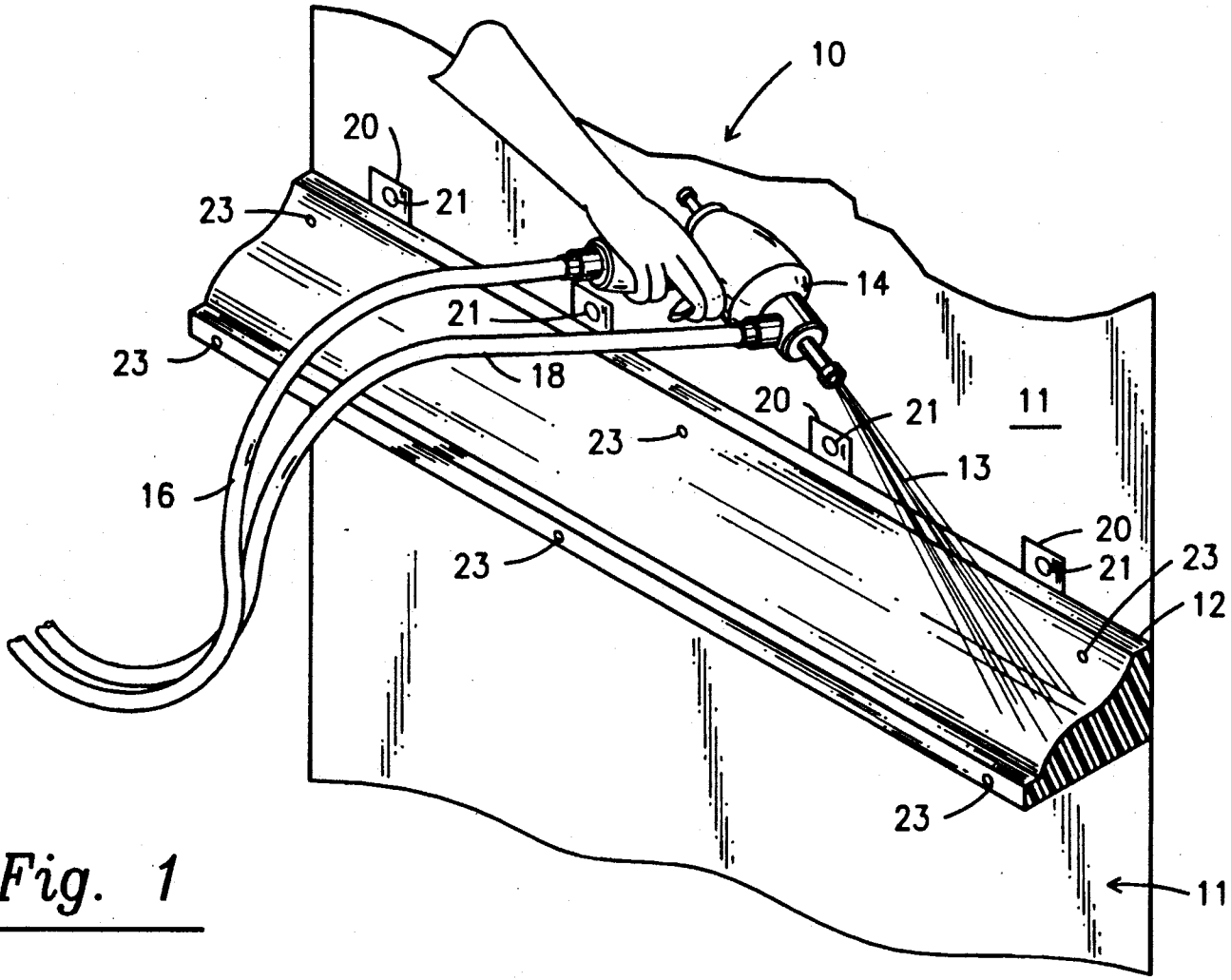

Referring now to the Fig., it will there be seen than an exemplary embodiment of the present invention is denoted as a whole by the reference numeral 10.

The EPS block 12 has a density of 1.5–3.0 pounds per cubic foot. Thus, it is a high density EPS, but it is still light-in-weight and is still easily cut into any free form shape with any amount of detail at the factory. Further, the higher density EPS material is much easier to coat since the surface of the material is less porous than the lower density foam. This is because the bonding of the foam beads used to form the EPS product is not as great in the lower density material; hence, the surface of the lower density material contains voids or spaces where the beads have not bonded tightly together. This condition is not prevalent in the higher density EPS product.

In the Fig., a worker is shown applying a thin film 13 of Sun Rock cementitious material to block 12. Sun Rock is a registered trademark of and is commercially available from Windstrup Construction Company of Tarpon Springs, Fla.

Sun Rock is an acrylic or epoxy modified cement, with or without fibers. The strength and durability of the Sun Rock coating varies depending on the exposure of the product, i.e., in a high volume shopping center where decorative columns of EPS are desired, the impact of shopping carts is probable. Therefore, an EPS with a density of three pounds and two coats of high impact Sun Rock coating is used in such environments. In an above ground decorative application where such impacts are improbable, a 1.5 pound density foam and one coat of Sun Rock is acceptable.

An ordinary type spray gun 14 of the type used by cementitious coaters is employed; hose 16 is an air hose and hose 18 delivers the Sun Rock material to said gun.

No open mesh sheet is used. After block 12 is cut into the desired ornament shape, a coating of Sun Rook, about 0.015 inch thick, is sprayed at the factory onto the EPS, and when that coating is dry, if necessary, a second coat of substantially equal thickness is sprayed onto the first coating.

In addition, metal tabs 20 are fastened to the product if it is to be installed on a masonry or cement surface 11. Said tabs 20 may be glued to the foam pieces at the factory or at the job site prior to installation. These tabs are then nailed 21 through with concrete nails to attach the foam piece to the masonry block. Foam board adhesive is also used when the material is applied in the field, but the metal fasteners insure that the piece remains in place until the adhesive dries. Fasteners 20 may be installed in several different planes; the installation determines the actual positioning of said fasteners. Since the metal tabs are relatively thin and have sharp edges it is preferable to attach them in the field. A solvent-based, instant bond glue that can be brushed onto foam without destroying or melting it is applied to the foam in each location where a tab is to be positioned; the solvent is evaporated from said glue before it is used. The tabs are then positioned where desired, and a strip of open mesh self-adhesive tape is placed into overlying relation thereto, and a thin layer of Sun Rock is then sprayed onto that structure and the attachment process is complete. The instant bond glue is also commercially available from Windstrup Construction Co.

If the product is to be secured to wood, sheet rock, or other nailable material, it may simply be nailed or screwed into said material by nails 23.

The finished product is then delivered to the job site and is attached to the building. Thus, no on site preparation of cementitious material or trowelling or spraying is required.

The Sun Rock product is complete and ready to install when received from the factory, i.e., it is allowed to cure before it is shipped.

Accordingly, the inventive method includes the steps of selecting a block of EPS having a density of 1.5–3.0 pounds per cubic foot, cutting said block into a preselected ornamental shape, spraying one or two coats of a cementitious material thereonto, each of said coatings being about 0.015 inch thick and affixing the finished product to a building with the attachment methods described.

This invention is clearly new and useful. Moreover, it was not obvious to those of ordinary skill in this art at the time this invention was made, in view of the prior art, taken as a whole. Perhaps even more importantly, this invention is a pioneering invention as that term is defined by the courts. Accordingly, the claims that follow are entitled to broad interpretation so as to protect from piracy the heart or essence of the invention, in accordance with the requirements of law.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. An article of manufacture having utility in the construction industry as a non-weight bearing, ornamental construction material that is attached to a building, comprising:

a block of high density expanded polystyrene having a density of about 3.0 pounds per cubic foot;

said block having an ornamental shape including details of construction that would be obliterated by a coating of cementitious material having a thickness of more than about 0.030 inch;

a first coating of a cementitious material disposed in overlying relation to said block;

said first coating being about 0.015 inch in thickness so that said details are not obliterated by said first coating;

whereby said expandable polystyrene is nailable or otherwise attachable to a building structure for ornamental purpose; and whereby said density of said block, coupled with said first coating of said cementitious material, provides a durable article of manufacture.

2. The article of claim 1, further comprising a seconds coating of said cementitious material disposed in overlying relation to said first coating;

said second coating being about 0.015 inch in thickness.

3. The article of claim 1, further comprising at least one tab means secured to an external surface of said block to facilitate attachment of said block to said building structure.

* * * * *